US010917726B2

(12) United States Patent
Zhong et al.

(10) Patent No.: US 10,917,726 B2
(45) Date of Patent: Feb. 9, 2021

(54) DIAPHRAGM AND SOUNDING DEVICE

(71) Applicant: AAC Technologies Pte. Ltd., Singapore (SG)

(72) Inventors: Zhiwei Zhong, Shenzhen (CN); Wei Song, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/236,398

(22) Filed: Dec. 29, 2018

(65) Prior Publication Data

US 2019/0238991 A1 Aug. 1, 2019

(30) Foreign Application Priority Data

Jan. 29, 2018 (CN) ..... 2018 2 0150567

(51) Int. Cl.

| | |
|---|---|
| ***H04R 9/06*** | (2006.01) |
| ***H04R 7/18*** | (2006.01) |
| ***H04R 7/12*** | (2006.01) |
| ***H04R 9/02*** | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 2307/023* (2013.01); *H04R 2307/027* (2013.01)

(58) Field of Classification Search

CPC ..... H04R 2307/023; H04R 2307/027; H04R 2307/029; H04R 7/18; H04R 7/16; H04R 7/22; H04R 7/24; H04R 7/127

See application file for complete search history.

(56) References Cited

U.S. PATENT DOCUMENTS

| | | | | |
|---|---|---|---|---|
| 4,272,653 | A * | 6/1981 | Osato | H04R 7/10 381/425 |
| 2007/0140519 | A1* | 6/2007 | Fukuyama | H04R 7/24 381/398 |
| 2012/0170778 | A1* | 7/2012 | Wei | H04R 9/06 381/191 |
| 2018/0130458 | A1* | 5/2018 | Chu | H04R 7/10 |

* cited by examiner

*Primary Examiner* — Sunita Joshi
(74) *Attorney, Agent, or Firm* — IPro, PLLC; Na Xu

(57) ABSTRACT

A diaphragm is provided, including a dome and a suspension extending from a periphery of the dome. The dome includes a stack of an aluminum foil layer, a foam layer and a carbon fiber layer. The dome is recessed from the aluminum foil layer toward the carbon fiber layer to form a receiving recess. The receiving recess is arranged surrounding the periphery of the dome. The suspension is partially received in the receiving recess and is fixed to the dome. A sounding device is also provided, the sounding device includes the diaphragm. The diaphragm and the sounding device of the present disclosure have better high frequency acoustic performance and excellent reliability.

6 Claims, 5 Drawing Sheets

DIAPHRAGM AND SOUNDING DEVICE

CROSS-REFERENCE TO RELATED APPLICATIONS

The present application claims priority to Chinese Patent Application No. 201820150567.0, filed on Jan. 29, 2018, the content of which is incorporated herein by reference in its entirety.

TECHNICAL FIELD

The present disclosure relates to the field of electric-acoustic technologies and, in particular, to a diaphragm and a sounding device applied to portable electronic products.

BACKGROUND

With the advent of the mobile internet era, the number of smart mobile devices is continuously increasing. Among so many mobile devices, mobile phones are undoubtedly the most common and portable mobile terminal devices. The sounding device for playing sound is widely applied to the existing smart mobile devices such as mobile phone and the like.

The sounding device in the related art includes a holder, a vibration system fixed to the holder, and a magnetic circuit system that drives vibration of the vibration system to sound. The vibration system includes a diaphragm fixed to the holder and a voice coil driving the diaphragm to vibrate. The diaphragm includes a dome and a vibration portion extending from a periphery of the dome. The vibration portion is fixed to the holder.

However, in the related art, the dome is made of a pure aluminum foil material such that the structural strength of the dome is limited, thereby affecting the high frequency acoustic performance of the sounding device.

Therefore, it is necessary to provide a new diaphragm and a sounding device to solve the above technical problems.

BRIEF DESCRIPTION OF DRAWINGS

In order to illustrate technical solutions of embodiments of the present disclosure, the accompanying drawings used in the embodiments are described below. The drawings described below are merely a part of the embodiments of the present disclosure. Based on these drawings, those skilled in the art can obtain other drawings without creative effort.

DESCRIPTION OF EMBODIMENTS

The technical solutions in embodiments of the present disclosure are described in details with reference to the accompanying drawings. The described embodiments are merely part of the embodiments of the present disclosure rather than all of the embodiments. All other embodiments obtained by those skilled in the art based on the embodiments of the present disclosure without paying creative effort shall fall into the protection scope of the present disclosure.

Figure 1:
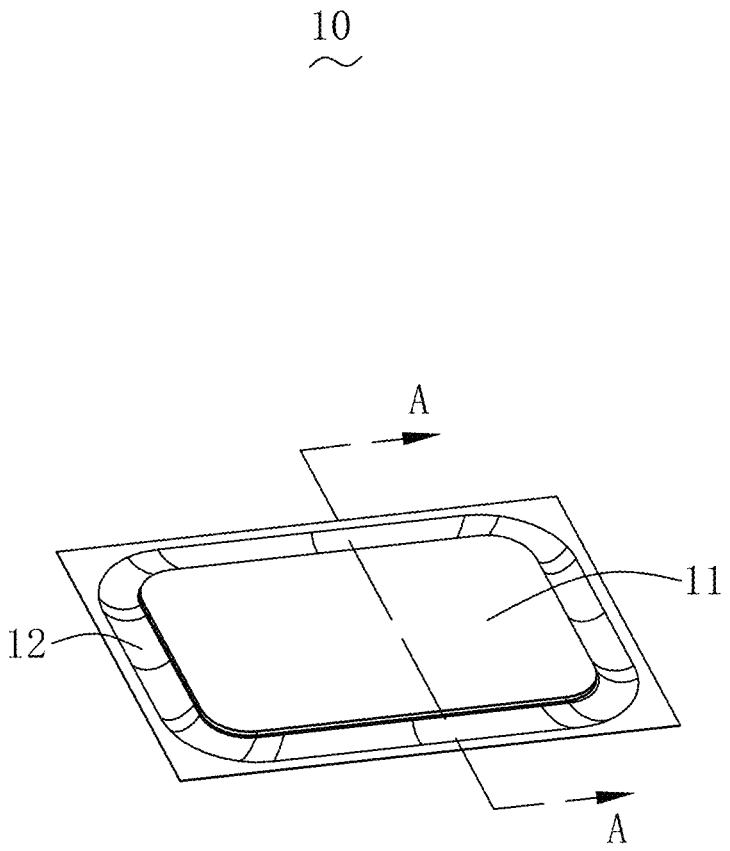
FIG. 1 is a schematic diagram showing a three-dimensional structure of a diaphragm according to an embodiment of the present disclosure.
Figure 2:
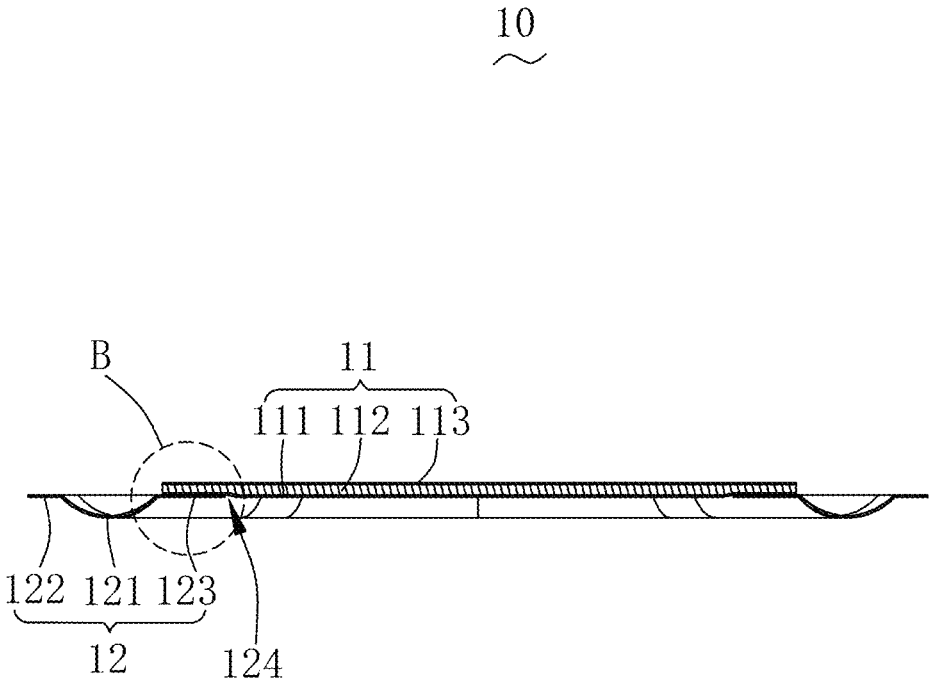
FIG. 2 is a cross-sectional view of the diaphragm in FIG. 1 taken along line A-A.
Figure 3:
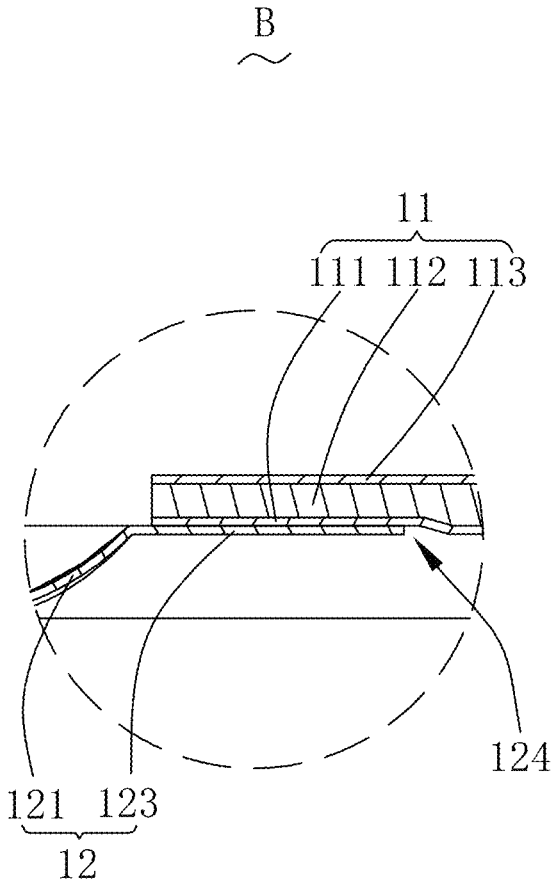
FIG. 3 is a partial enlarged view of portion B shown in FIG. 2.

Referring to FIGS. 1-3, the present disclosure provides a diaphragm 10. The diaphragm 10 includes a dome 11 and a suspension 12 extending from a periphery of the dome 11. In an embodiment of the present disclosure, the suspension 12 is fixed to the dome 11 by gluing, and of course, the fixing manner thereof is not limited to gluing.

The dome 11 is configured to increase high frequency acoustic performance. The suspension 12 is configured to increase the vibration strength of the diaphragm 10.

In one embodiment, the dome 11 includes a stack of an aluminum foil layer 111, a foam layer 112, and a carbon fiber layer 113. The dome 11 is recessed from the aluminum foil layer 111 toward the carbon fiber layer 113 to form a receiving recess 124. The receiving recess 124 is arranged surrounding the periphery of the dome 11. The suspension 12 is fixed to a side of the dome 11 close to the aluminum foil layer 111, that is, the suspension is partially received in the receiving recess 124 and fixed to the aluminum foil layer 111 of the dome 11.

Since the aluminum foil layer 111 has good ductility, is easy to process, and has no obvious burrs on the edges, it can be tightly glued with the suspension 12, thus reliability is good.

In addition, the carbon fiber layer 113 has a greater strength than the aluminum foil layer 111, that is, the carbon fiber layer 113 increases the overall structural strength of the dome 11, thus having higher frequency acoustic performance.

The suspension 12 includes a recessed portion 121 in an arc shape, a first fixing portion 122 and a second fixing portion 123. The first fixing portion 122 and the second fixing portion 123 respectively extend from two opposite sides of the recessed portion 121. The first fixing portion 122 is configured to support and fix the structure applying to the diaphragm 10. The second fixing portion 123 is fixed to the dome 11. In one embodiment, the second fixing portion 123 is received in the receiving portion 124 and fixed to the aluminum foil layer 111 of the dome 11.

In one embodiment of the present disclosure, the recessed portion 121 is formed by recessing toward the aluminum foil layer 111 along the carbon fiber layer 113. It is appreciated that, the recessed portion 121 is also possibly formed by recessing toward the carbon fiber layer 113 along the aluminum foil layer 111.

Figure 4:
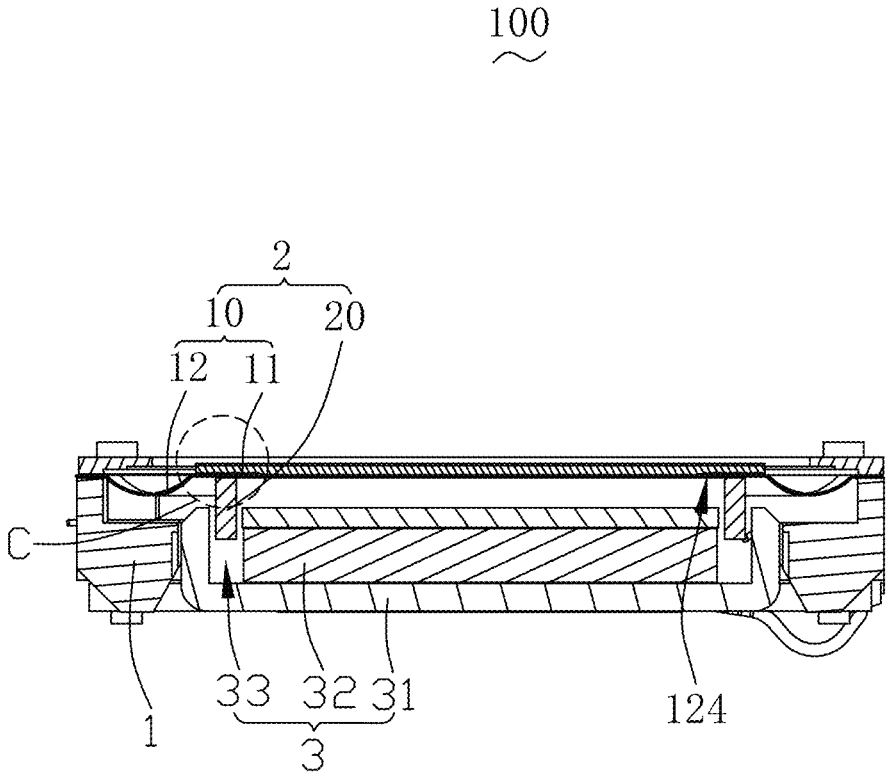
FIG. 4 is a schematic structural cross-sectional view showing a sounding device according to an embodiment of the present disclosure.
Figure 5:
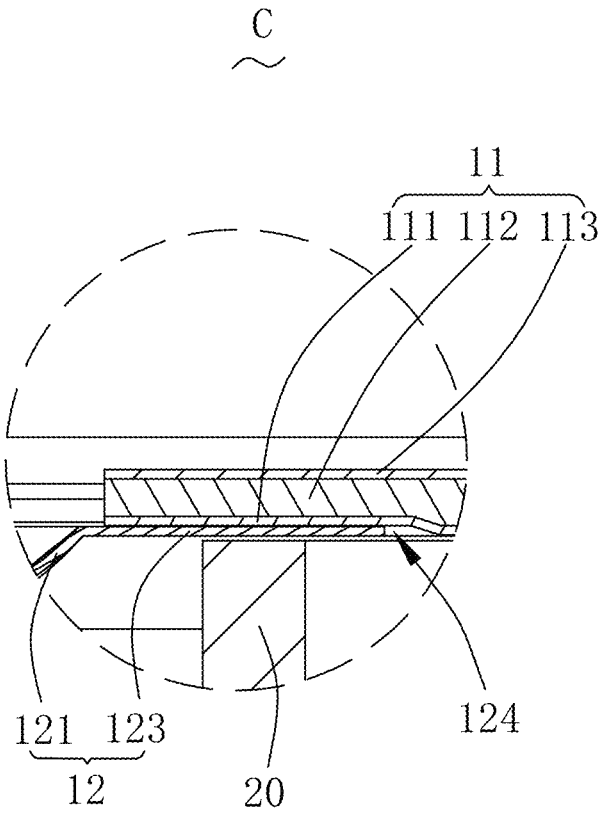
FIG. 5 is a partial enlarged view of portion C shown in FIG. 4.

Referring to FIGS. 4-5, the present disclosure further provides a sounding device 100. The sounding device 100 includes a holder 1, a vibration system 2 fixed to the holder 1, and a magnetic circuit system 3 for driving the vibration system 2 to vibrate and sound.

The vibration system 2 includes the diaphragm 10 and a voice coil 20 driving the diaphragm 10 to vibrate. The diaphragm 10 is fixed to the holder 1.

The magnetic circuit system 3 includes a yoke 31 and a magnet 32 fixed in the yoke 31. The magnet 32 is spaced apart from the yoke 31 to form a magnetic gap 33. The voice coil 20 is inserted into the magnetic gap. In an embodiment of the present disclosure, the aluminum foil layer 111 of the dome 11 is arranged opposite to the magnetic circuit system 3.

In one embodiment, the first fixing portion 122 of the suspension 12 is fixed to the holder 1. The second fixing portion 123 of the suspension 12 is fixed to the dome 11. The second fixing portion 123 of the suspension 12 is fixed to a side of the dome 11 close to the magnetic circuit system 2, that is, the second fixing portion 123 is fixed to the aluminum foil layer 111 and received in the receiving recess 124. The recessed portion 121 of the suspension 12 is recessed toward a direction close to the magnetic circuit system 3.

The voice coil 20 is fixed to a side of the suspension 12 facing away from the dome 11. In an embodiment of the present disclosure, the voice coil 20 is fixed to the second fixing portion 123 and inserted into the magnetic gap 33.

In one embodiment, an orthographic projection of the voice coil 20 in a direction of the diaphragm 10 is completely located in the receiving recess 124. With the arrangement of such a structure, the receiving recess 124 can save a gluing space at the inner side thereof for the voice coil 20, thereby avoiding that overflow of the glue affects the acoustic performance when the voice coil 20 is glued to the second fixing portion 123.

Compared with the related art, in the diaphragm and the sounding device according to the present disclosure, the dome of the diaphragm adopts a composite structure formed by sequentially stacking an aluminum foil layer, a foam layer and a carbon fiber layer, and the dome is recessed from the aluminum foil layer toward the carbon fiber layer to form a receiving recess, because the aluminum foil layer has good ductility, is easy to process, and has no obvious burrs on the edges, it can be tightly glued with the suspension, thus having good reliability. Meanwhile, the carbon fiber layer has a greater strength than the aluminum foil layer, so that the overall structural strength of the dome is increased, thereby effectively improving the high frequency acoustic performance of the sounding device. In addition, the voice coil is fixed to the suspension and located in the receiving recess. That is to say, the receiving recess can save a gluing space at the inner side thereof for the voice coil, thereby avoiding that overflow of the glue affects the acoustic performance.

The above are only preferred embodiments of the present disclosure. Here, it should be noted that those skilled in the art can make modifications without departing from the inventive concept of the present disclosure, but these shall fall into the protection scope of the present disclosure.

What is claimed is:

1. A diaphragm, comprising:

a dome comprising a stack of an aluminum foil layer, a foam layer and a carbon fiber layer, and a suspension extending from a periphery of the dome, wherein the dome is recessed from the aluminum foil layer toward the carbon fiber layer to form a receiving recess, the receiving recess is arranged surrounding the periphery of the dome, and the suspension is partially received in the receiving recess and is fixed to the dome, wherein the suspension comprises a recessed portion having an arc shape, a first fixing portion and a second fixing portion, wherein the first fixing portion and the second fixing portion respectively extend from two opposite sides of the recessed portion, and the second fixing portion is received in and fixed to the receiving recess.

2. The diaphragm as described in claim 1, wherein the recessed portion is formed by recessing toward the aluminum foil layer along the carbon fiber layer.

3. The diaphragm as described in claim 1, wherein the suspension is fixed to the dome by gluing.

4. A sounding device, comprising:

a holder, a vibration system fixed to the holder, and a magnetic circuit system configured to drive the vibration system to vibrate and sound, wherein the vibration system comprises the diaphragm according to claim 1 and a voice coil configure to drive the diaphragm to vibrate, and the diaphragm is fixed to the holder.

5. The sounding device as described in claim 4, wherein the voice coil is fixed to a side of the suspension facing away from the dome.

6. The sounding device as described in claim 5, wherein an orthographic projection of the voice coil in a direction of the diaphragm is completely located within the receiving recess.

* * * * *